US008845453B1

(12) United States Patent
Ehlers

(10) Patent No.: US 8,845,453 B1
(45) Date of Patent: Sep. 30, 2014

(54) GOLF CLUB HEAD WITH IMPROVED AERODYNAMIC CHARACTERISTICS

(71) Applicant: Callaway Golf Company, Carlsbad, CA (US)

(72) Inventor: Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 14 days.

(21) Appl. No.: 13/790,115

(22) Filed: Mar. 8, 2013

(51) Int. Cl.
*A63B 53/04* (2006.01)

(52) U.S. Cl.
CPC ..... *A63B 53/0466* (2013.01); *A63B 53/04* (2013.01)
USPC ..... 473/327; 473/345; 473/330; 473/343

(58) Field of Classification Search
USPC ..... 473/327, 345, 330, 343
See application file for complete search history.

(56) References Cited

U.S. PATENT DOCUMENTS

| | | | | |
|---|---|---|---|---|
| 4,023,802 | A * | 5/1977 | Jepson et al. | 473/309 |
| 4,838,555 | A * | 6/1989 | Kobayashi | 473/327 |
| 5,092,599 | A * | 3/1992 | Okumoto et al. | 473/327 |
| 2012/0015757 | A1 * | 1/2012 | Evans et al. | 473/327 |

* cited by examiner

*Primary Examiner* — Benjamin Layno
(74) *Attorney, Agent, or Firm* — Rebecca Hanovice; Michael A. Catania; Sonia Lari

(57) ABSTRACT

Designs and methods of improving aerodynamic performance of golf club heads are disclosed herein. In particular, the designs and methods of the present invention address airflow behavior modification at or immediately adjacent to the counter or edge of the striking face to reduce club head drag while minimizing any adverse effect on the impact performance of the face. The present invention also provides a face with visually distinct and apparent treatments and improved visibility at address. The approaches to contouring a golf club face disclosed herein are new because they are confined to a relatively narrow band along the inside of the face boundary curve. The dimensions of the modification zone are kept small and subtle contour changes are made to influence airflow in a highly critical region with minimal effect on the impact performance of the striking surface.

20 Claims, 5 Drawing Sheets

GOLF CLUB HEAD WITH IMPROVED AERODYNAMIC CHARACTERISTICS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to designs and methods for reducing the effects of drag forces present during the use of a golf club head that conform to the U.S.G.A. Rules of Golf.

2. Description of the Related Art

Golf club designs, and driver designs in particular, have recently trended to include characteristics intended to increase the club's inertia values to help off-center hits go farther and straighter. Driver designs have also recently included larger faces, which may help the driver deliver better feeling shots as well as shots that have higher ball speeds if hit away from the face center. These recent trends can, however, be detrimental to the driver's performance due to the head speed reductions that these design features introduce due to the larger geometries. In fact, a wood or metal wood club head behaves aerodynamically as a bluff body during downswing, exhibiting large separated flow regions and generating significant drag forces, which reduce head speed and can negatively affect control of the club during a swing.

Numerous approaches to reducing the drag of woods, including metal wood, club heads have been proposed. The majority of these approaches involve modification or addition of features to the body of the club, exclusive of the striking surface or face. These include changes to the crown, sole, ribbon, toe, and heel portions of the club, referred to herein as "body only" modifications. Examples of such methods include the embodiments disclosed in U.S. Pat. No. 6,942,581 to Kim et al., U.S. Pat. No. 6,773,359 to Lee, U.S. Pat. No. 6,074,308 to Domas, U.S. Pat. No. 5,980,394 to Domas, U.S. Pat. No. 5,954,595 to Antonious, U.S. Pat. No. 5,735,754 to Antonious, U.S. Pat. No. 5,700,208 to Nelms, U.S. Pat. No. 5,511,786 to Antonious. U.S. Pat. No. 5,203,565 to Murray et al., U.S. Pat. No. 5,221,086 to Antonious, U.S. Pat. No. 5,913,810 to Antonious, U.S. Pat. No. 5,120,061 to Tsuchida et al., U.S. Pat. No. 4,850,593 to Nelson, and U.S. Pat. No. 4,444,392 to Duclos. While this type of approach may maintain the impact properties of the face, the aerodynamic benefits of these designs treatments are greatly reduced by the large scale flow separation created by traditional face geometry. In addition, many of these designs violate the "plain in shape" requirements of the U.S.G.A. Rules of Golf as described in Rule 4a, Appendix II.

Several other prior art designs include significant geometric changes to both the body and the striking surface. Examples of these designs include the embodiments disclosed in U.S. Pat. No. 5,997,413 to Wood, U.S. Pat. No. 5,803,830 to Austin et al., U.S. Pat. No. 5,674,136 to Gorse, U.S. Pat. No. 5,318,297 to Davis et al., U.S. Pat. No. 5,271,622 to Rogerson, U.S. Pat. No. 4,900,029 to Sinclair, U.S. Pat. No. 4,809,982 to Kobayashi, and U.S. Pat. No. 4,431,192 to Stuff, Jr. These designs exhibit the same problems as the "body only" modification approaches. Furthermore, modification of these clubs' face geometry also tends to yield poorer impact performance.

Some prior art designs are characterized by through-holes extending from the face. Examples of this design characteristic are shown in the embodiments disclosed in U.S. Pat. No. 6,824,474 to Thill, U.S. Pat. No. 6,319,148 to Tom, U.S. Pat. No. 6,165,080 to Salisbury, U.S. Pat. No. 6,027,414 to Koebler, U.S. Pat. No. 5,944,614 to Yoon, U.S. Pat. No. 5,807,187 to Hamm, U.S. Pat. No. 5,681,227 to Sayrizi, U.S. Pat. No. 5,524,890 to Kim et al., U.S. Pat. No. 5,158,296 to Lee, and U.S. Pat. No. 5,054,784 to Collins. Though this technique can provide aerodynamic benefits via wake ventilation, it also fails to conform to the Rules of Golf and can adversely affect impact performance. A similar approach utilizes grooves or channels that extend to the face or striking surface, examples of which are shown in the embodiments disclosed in U.S. Pat. No. 5,004,241 to Antonious. U.S. Pat. No. 4,930,783 to Antonious, U.S. Pat. No. 4,828,265 to Antonious, and U.S. Pat. No. 4,065,133 to Gordos. These approaches can also have an adverse effect on impact performance, and are also nonconforming under the Rules of Golf plain in shape" requirement.

A few prior art approaches attempt to alter the face shape, including those disclosed in U.S. Pat. No. 5,944,620 to Elmer, U.S. Pat. No. 5,961,397 to Lu et al., U.S. Pat. No. 5,747,666 to Lovett, and U.S. Pat. No. 3,976,299 to Lawrence et al. The problem with these designs, however, is that their structure can negatively affect impact performance of the face. For instance, reducing or eliminating the high center region of the face removes a common hit location, thus reducing the forgiveness and effectiveness of the club.

It is clear from the references discussed above that the prior art fails to provide golf club designs that efficiently reduce drag forces, enable the golf club to be swung faster along its path, and improve the impact event with the golf ball.

BRIEF SUMMARY OF THE INVENTION

The designs and methods of the present invention increase club head speed by reducing the aerodynamic drag created during a club's downswing while maintaining the desired impact performance of the striking surface. The approaches disclosed herein result in greater distance without significantly affecting launch conditions for hit locations over most of the face. These approaches also reduce the need for elaborate, and potentially nonconforming, modifications or added features on the body, and can enhance the performance of downstream modifications and features by promoting attached flow.

One challenge to these approaches is the need to modify the outer contour of the face such that aerodynamic drag is reduced while maintaining the impact properties of the face. Any change to the striking surface orientation and curvature can affect launch conditions adversely. Therefore, the magnitude and type of change must be carefully controlled and designed. Aerodynamic behavior of a bluff body is highly nonlinear. Relatively small changes to surface contours at key locations can have profound and beneficial effects to overall airflow, especially downstream. This type of leverage can be used to contribute to significant reductions in drag. The approaches disclosed herein also provide additional design freedom that can be used to affect the appearance of the driver face at address, to influence sound and feel, and to provide for increased face compliance.

One aspect of the present invention is a golf club head comprising a face component comprising a geometric center, a striking surface, a face edge, and perimeter modification zone, and a body comprising a crown, a sole, a heel end, and a toe end, wherein the face edge is defined by the intersection between the striking surface and the crown, sole, heel end, and toe end, and extends around the entire periphery of the striking surface, wherein the perimeter modification zone extends inward from the face edge towards the geometric center by a distance that is no less than 0.050 inch and no more than 0.50 inch, and wherein the perimeter modification zone includes an aerodynamic feature. In some embodiments, the aerodynamic feature may be selected from the group consisting of a straight line, a constant radius, and a Nonuniform Rational B-Spline (NURBS) configuration. The distance by which the perimeter modification zone extends towards the geometric center may, in some embodiments, be consistent around the periphery of the face and be approximately 0.25 inch.

In some embodiments, the perimeter modification zone may comprise at least one secondary surface feature selected from the group consisting of a curvature discontinuity, a step discontinuity, a protrusion, and a groove. In some further embodiments, the secondary surface feature may be a protrusion selected from the group consisting of a rib and a cusp-shaped ridge. In other embodiments, the golf club head may further comprise a transition zone extending from the face edge away from the face component onto the body, and the transition zone may comprise a surface feature selected from the group consisting of a curvature discontinuity, a step discontinuity, a protrusion, and a groove. In some further embodiments, the surface feature may be a protrusion selected from the group consisting of a rib and a cusp-shaped ridge. In other embodiments, the face edge may have a perimeter shape selected from the group consisting of a uniform, sinusoidal or scalloped shape, a non-uniform, sinusoidal shape, a uniform, saw tooth shape, and a non-uniform saw tooth shape.

In some embodiments, the perimeter modification zone may completely encircle the striking surface, and in a further embodiment it may have a variable distance. In an alternative embodiment, the perimeter modification zone may only partially encircle the striking surface. In some embodiments, the face component may be manufactured from a metal material using a technique selected from the group consisting of forging, forming, and machining, and in other embodiments the body may be composed of a lightweight material selected from a low-density metal alloy and carbon composite.

Another aspect of the present invention is a driver-type golf club head comprising a metal face component comprising a geometric center, a striking surface, a face edge, and perimeter modification zone, and a body comprising a crown, a sole, a heel end, a toe end, and a transition zone, wherein the face edge is defined by the intersection between the striking surface and the crown, sole, heel end, and toe end, and extends around the entire periphery of the striking surface, wherein the transition zone extends from the face edge away from the face component onto the body and comprises a first surface feature selected from the group consisting of a curvature discontinuity, a step discontinuity, a protrusion, and a groove, wherein the perimeter modification zone extends inward from the face edge towards the geometric center by a constant distance of approximately 0.25 inch, wherein the perimeter modification zone completely encircles the striking surface, and wherein the perimeter modification zone includes an aerodynamic feature selected from the group consisting of a straight line, a constant radius, and a Nonuniform Rational B-Spline (NURBS) configuration. In some embodiments, the perimeter modification zone may comprise at least one secondary surface feature selected from the group consisting of a curvature discontinuity, a step discontinuity, a protrusion, and a groove. In other embodiments, the face component may be forged.

Yet another aspect of the present invention is a face cup for a golf club head, the face cup comprising a striking face comprising a geometric center, a face edge, and perimeter modification zone, and a return portion comprising a crown portion, a sole portion, a heel end portion, a toe end portion, and a transition zone, wherein the face edge is defined by the intersection between the striking face and the crown portion, sole portion, heel end portion, and toe end portion, and encircles the striking face, wherein the perimeter modification zone extends inward from the face edge towards the geometric center by a distance of no more than 0.50 inch, wherein the perimeter modification zone completely encircles the striking surface, and wherein the perimeter modification zone includes an aerodynamic feature selected from the group consisting of a straight line, a constant radius, and a Nonuniform Rational B-Spline (NURBS) configuration. In some embodiments, at least one of the transition zone and the perimeter modification zone may comprise at least one surface feature selected from the group consisting of a curvature discontinuity, a step discontinuity, a protrusion, and a groove. In other embodiments, the distance at which the perimeter modification zone extends inwards from the face edge may be variable. In still other embodiments, the face edge may have a perimeter shape selected from the group consisting of a uniform, sinusoidal or scalloped shape, a non-uniform, sinusoidal shape, a uniform, saw tooth shape, and a non-uniform saw tooth shape.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The face, or striking surface, of a golf club head, and particularly a driver, is critical to the club's function because it has a primary role in determining golf ball speed, spin, and direction after impact. The face also affects the sound and feel of the club, and its size is important as a consideration for forgiveness to mishits. With regard to the aerodynamic performance of a golf club head, however, the face is a major contributor to aerodynamic drag during downswing prior to impact, as it tends to dissipate swing energy and reduce the speed of the club head, thus reducing the distance a golf ball will travel. During downswing, the face essentially behaves as a flat plate, creating high pressure forces and contributing to flow separation, and resulting in significant base drag. This behavior is especially noticeable during the latter stages of the downswing when the head is moving at high speed and the face is rotating into an orientation close to perpendicular to the local airflow.

These face pressure forces can be reduced and attached flow or flow reattachment can be promoted by modifying the surface contour of a region adjacent to the edge of the face. Limiting the contour changes to a relatively narrow band near the edge of the face maintains its impact performance, which is critical to club head performance, for the great majority of hit locations. For most impact locations, modification of a region at the edge of the face also will not affect golf ball initial velocity, direction or spin. This approach is novel because the face design is not optimized with the single goal of providing the desired launch conditions over the entire striking surface, nor is a smaller face, which would also reduce aerodynamic drag, pursued. Instead, the designs and methods of the present invention focus on modifying a portion of the face to reduce drag and improve overall club head performance, while at the same time increasing visibility, face compliance, and the ability to control the golf club head's sound, feel, and resulting ball speed.

Figure 1:
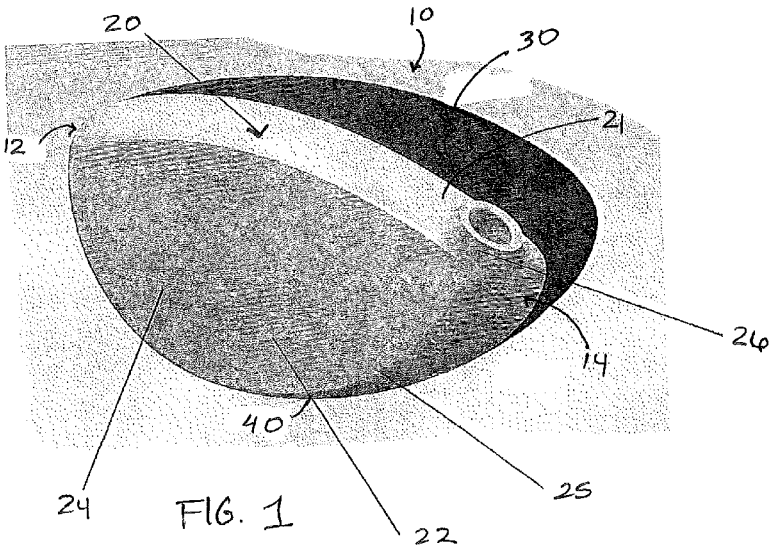
FIG. 1 is a side perspective view of a typical driver-type golf club head.
Figure 2:
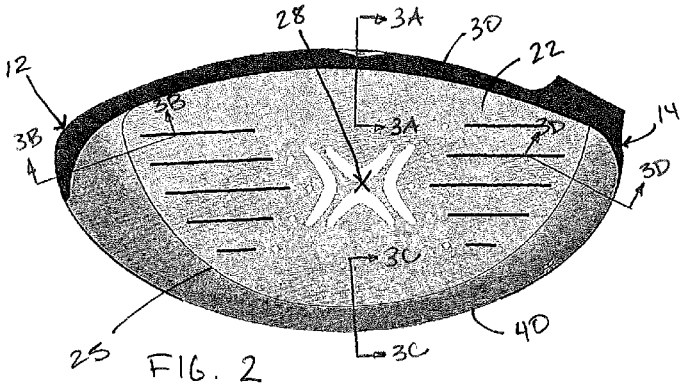
FIG. 2 is a front perspective view of the golf club head shown in FIG. 1.
Figure 3A:
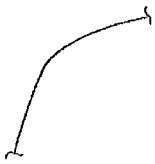
FIGS. 3A-3D are profile views of the face to crown, face to toe, face to sole, and face to heel transition portions of the golf club head shown in FIG. 2 along lines 3A-3A, 3B-3B, 3C-3C, and 3D-3D, respectively.
Figure 3B:
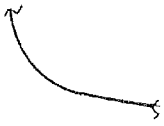
Figure 3C:
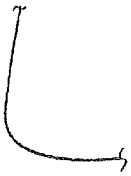
Figure 3D:
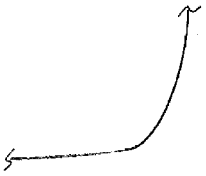
Figure 4:
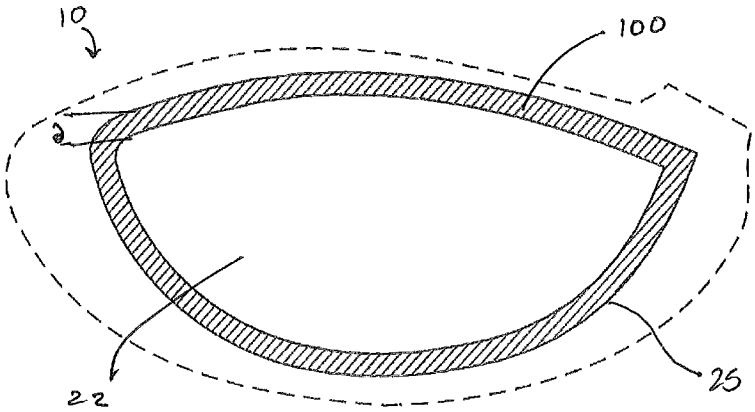
FIG. 4 is a front plan view of a first embodiment of the present invention with a shaded area showing a uniform face surface perimeter modification zone.
Figure 6:
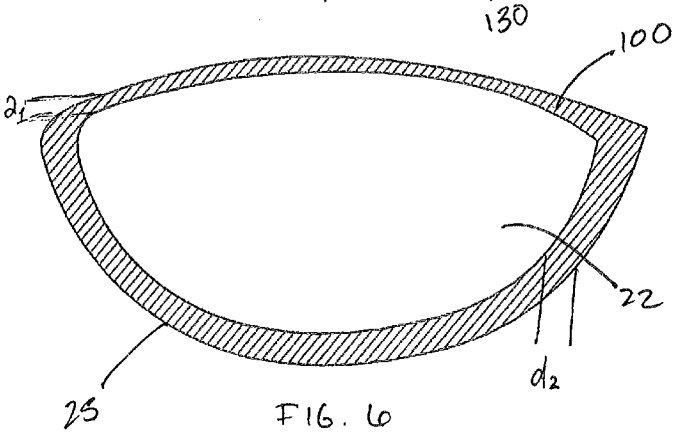
FIG. 6 is a front plan view of a second embodiment of the present invention with a shaded area showing a non-uniform face surface perimeter modification zone.

As shown in FIG. 1, a typical golf club head 10 comprises a toe side 12, a heel side 14, a face component 20 with a striking face 22, grooves or scorelines 24, a face curve or face edge 25 located at the perimeter of the striking face 22, a hosel 26 (which in alternative embodiments may be affixed to other parts of the golf club head 10), and a geometric center 28, a crown 30, and a sole 40. The face component 20 may be a face cup as shown in FIG. 1, with a return portion 21 surrounding the striking face 22, or it may be a face plate or face insert. FIGS. 2, 3A, 3B, 3C, and 3D illustrate key sections of the face edge 25 and the typical cross-sectional profiles of those sections. FIG. 4 illustrates the location and general shape of a perimeter modification zone 100 located along the perimeter of the striking face 22. According to the designs and methods of the present invention, changes are made to the striking face 22 within the perimeter modification zone 100 to improve the aerodynamic performance of the golf club head 10. In the preferred embodiment, shown in FIG. 3, the width or distance 6 of the perimeter modification zone 100 is constant. However, as shown in FIG. 6, in an alternative embodiment the width of the perimeter modification zone 100 can vary around the face edge 25 (e.g., δ1 and δ2, and may vanish at some locations.

Figure 5:
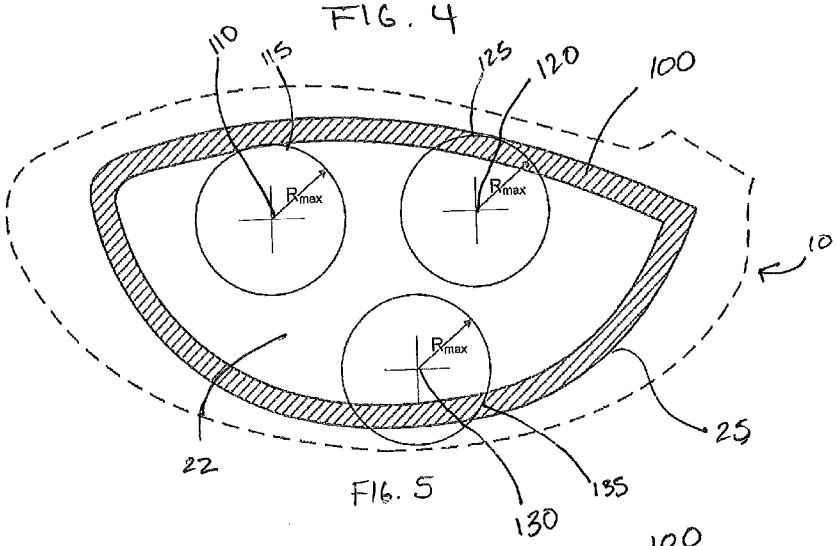
FIG. 5 is a front plan view of the embodiment shown in FIG. 4 showing three different impact locations and resulting areas of maximum face contact relative to the perimeter modification zone.

FIG. 5 illustrates three possible face impact locations 110, 120, 130 where the striking face 22 can make contact with a golf ball (not shown), and the maximum contact area 115, 125, 135 for each location 110, 120, 130 with respect to the face edge 25 and the perimeter modification zone 100. As illustrated in this Figure, the first impact location 110 and its maximum contact area 115 are contained entirely within the unmodified portion of the striking face 22. As a result, face surface modification has no effect of on golf ball impact behavior at this impact location 110.

In contrast, the maximum contact area 125 of the second impact location 120 overlaps part of the perimeter modification zone 100. In this case, modification of the striking face 22 within the perimeter modification zone 100 has a limited effect on golf ball impact behavior. The effect is limited because the contact area 125 varies over the time of the impact event, and the golf ball only contacts the perimeter modification zone 100 for a fraction of the contact time, such that the contact pressures are lower at the edge of the contact area 125 than at the center. At the first instant of contact between the striking face 22 and a golf ball at the second impact location 120, the contact area 125 is zero. As the ball compresses on the striking face 22, the contact area 125, which is approximately circular, reaches a maximum radius.

During the latter half of the contact phase, known as recovery, the contact area 125 declines from its maximum value back to zero. The impact pressure over the contact area between ball and striking face 22 is non-uniform, with a maximum value at the center and zero at the edge with an approximately cosine distribution. As a result, the total impulse delivered by the area within the perimeter modification zone 100 is a fraction of the total impulse delivered during golf ball impact. Thus, the effect of surface contour changes within the zone is limited for this impact location 120.

The contact area 135 for the third impact location 130 extends beyond the original face edge 25. In this case, the perimeter modification zone 100 is part of the contact area 135 for most of the impact and contact pressures are near the maximum value, and the effect of surface modification within the perimeter modification zone 100 is much more significant. However, even for an unmodified face, reduced performance for impacts at this location is expected. Furthermore, the percentage of hits at the third impact location 130 is much lower than the percentages of hits at the first and second impact locations 110, 120. As such, it is clear from FIG. 5 that modification of the face surface within the perimeter modification zone 100 has a limited affect on overall face performance.

Figure 7:
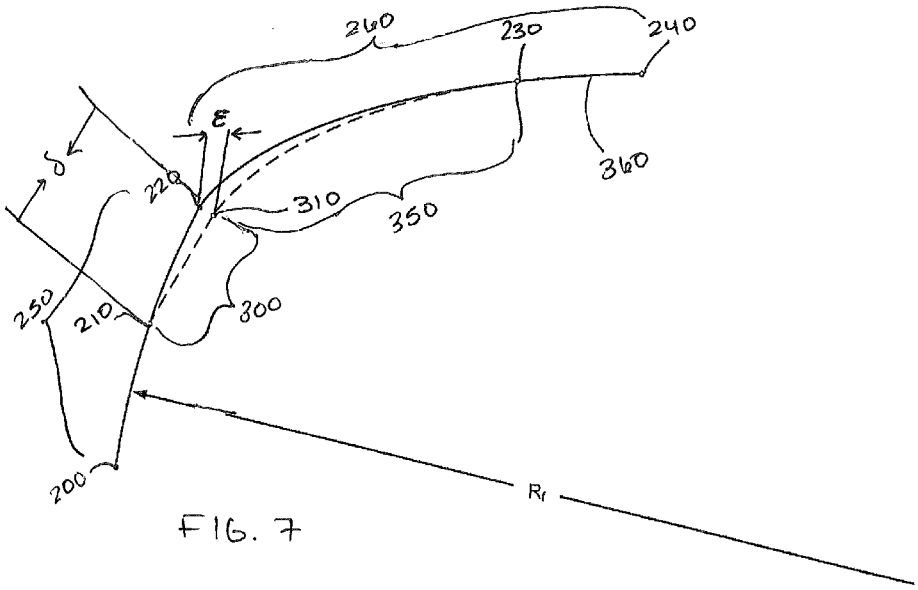
FIG. 7 is profile view of a typical golf club face to body transition geometry with a first embodiment of a perimeter modification profile superimposed in dashed line format.

The embodiments shown in FIGS. 7 through 11G illustrate the types of changes that can be made to a golf club face within the perimeter modification zone 100 to improve aerodynamic performance according to the present invention. In FIG. 7, segments 250 and 260 illustrate a section profile of a traditional driver-type golf club head from face to body. Segment 250, which begins at an interior face point 200 and ends at the face edge 220, represents an unmodified, traditional face profile, and typically has a constant radius $R_f$, while segment 260 represents the unmodified transition profile extending from the face edge 220 to the body 240 of the golf club head 10. The section shown in FIG. 7 is perpendicular to the face edge 220.

In FIG. 7, the segment 300 corresponding to the perimeter modification zone 100 extends from a midpoint 210 of the original segment 250 to an alternate edge point 310, which is offset from the original face edge 220 surface by a distance F. The offset distance $\epsilon$ preferably is no more than 0.050 inches and no less than 0.003 inches, and more preferably is about 0.015 inches. The width of the perimeter modification zone 100 is the distance 6 from the original face edge 220 to the midpoint 210 (extending away from the face edge 220 towards the geometric center 28), and preferably no less than 0.050 inch and no more than 0.50 inch, and more preferably is approximately 0.25 inches. Offsetting the edge point 310 from the original face edge 220 necessitates a change in the transition profile 260. The modified transition profile 350 extends from the alternate edge point 310 to the point 230 at which the modified transition profile 350 meets the original, unmodified transition shape.

Figure 8:
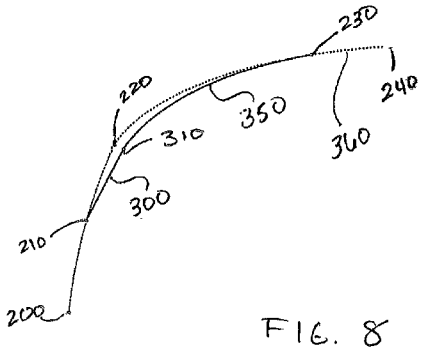
FIG. 8 is a profile view of a typical golf club face to body transition geometry in dashed format with a second embodiment of a perimeter modification profile superimposed in solid line format.
Figure 9:
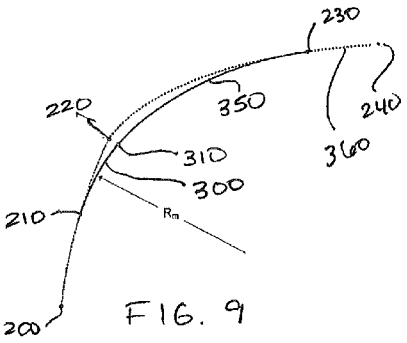
FIG. 9 is a profile view of a typical golf club face to body transition geometry in dashed format with a third embodiment of a perimeter modification profile superimposed in solid line format.
Figure 10:
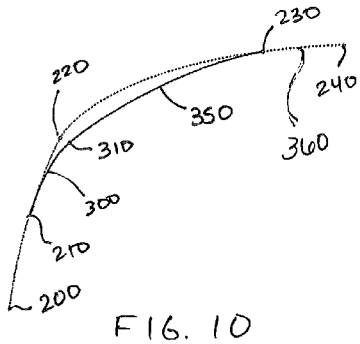
FIG. 10 is a profile view of a typical golf club face to body transition geometry in dashed format with a fourth embodiment of a perimeter modification profile superimposed in solid line format.

FIGS. 8-10 illustrate other changes that can be made to the golf club face within the perimeter modification zone 100 and also how the modified transition profile 350 can be connected to the perimeter modification zone 100 segment 300. The simplest geometric shapes for the perimeter modification zone 100 segment 300 are a straight line, shown in FIG. 8, and a constant radius $R_m$, shown in FIG. 9. The segment 300 may also have a Nonuniform Rational B-Spline (NURBS) configuration as shown in FIG. 10.

It is important to note the types of geometric continuity at the midpoint 210 and the alternate edge point 310. Different types of continuity, or discontinuity, may be used to influence aerodynamic and impact performance, and three types of continuity of geometry are present at both points 210, 310. It is most likely that positional geometric continuity ($G^0$) will be present, but a jump in the form of an aerodynamically significant may be used. Continuous slope or tangential continuity ($G^1$) is also possible. In this case, the slope matches at the point, but there is a change in position or curvature. Curvature continuity ($G^2$) is also a candidate characteristic at the ends of the segment 300.

Figure 11A:
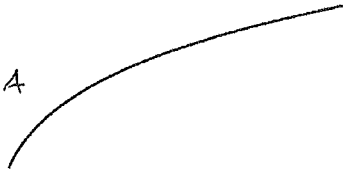
FIGS. 11A-11H are profile views of different embodiments of surface features for use within the perimeter modification zone to influence aerodynamic behavior and reduce drag.
Figure 11B:
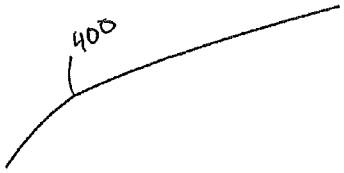
Figure 11C:
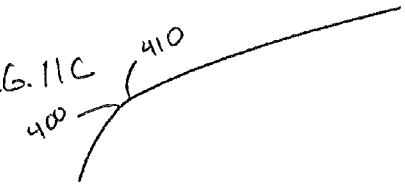
Figure 11D:
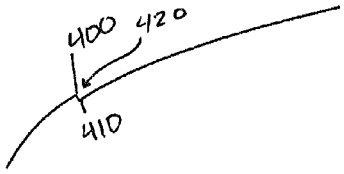
Figure 11E:
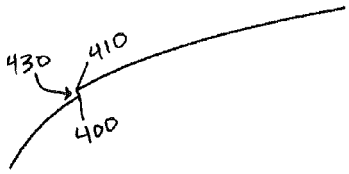
Figure 11F:
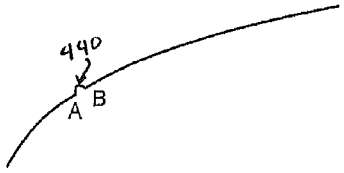
Figure 11G:
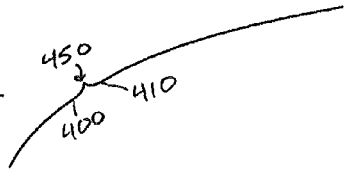
Figure 11H:
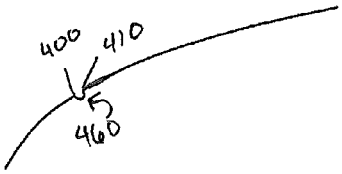
Figure 12A:
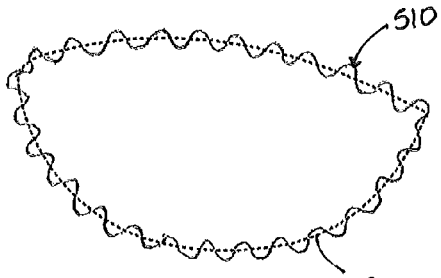
FIGS. 12A-12D are front plan views of golf club heads having different embodiments of face perimeters compared with a traditional face perimeter shown in dashed line format.
Figure 12B:
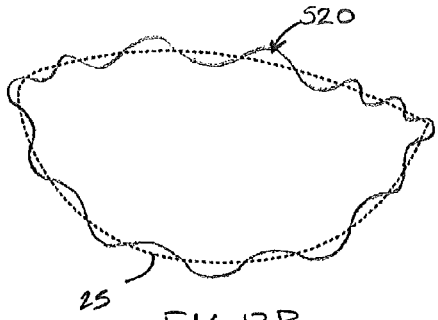
Figure 12C:
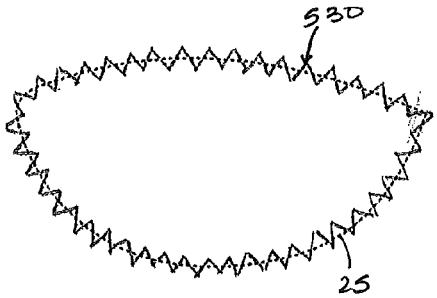
Figure 12D:
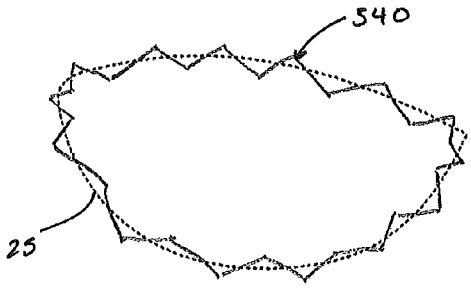

FIGS. 11A through 11H illustrate different embodiments of surface features that can be used at the midpoint 210 and the alternate edge point 310, within the perimeter modification zone 100 segment 300, along the modified transition profile 350, or on the unmodified portion 360 of the transition profile to influence the golf club head's 10 aerodynamic behavior and reduce drag. These features trigger transition from laminar to turbulent flow to keep the boundary layer attached. A baseline transition shape, exhibiting continuous position, slope and curvature, is shown in FIG. 11A. FIG. 11B illustrates a slope discontinuity at the edge point 400. An example of a curvature discontinuity is shown in FIG. 11C. In this example, the curve goes from a relatively large radius prior to the edge point 400 to a tighter radius from the edge point 400 to a rearward point 410, then back to a large radius past the rearward point 410. Two types of step, or position, discontinuities 420, 430 are shown in FIGS. 11D and 11E. An aft facing 420 step is shown in FIG. 11D, while FIG. 11E illustrates a forward facing step 430. Examples of two types of protrusions 440, 450 are given in FIGS. 11F and 11G. FIG. 11F shows an external rib or ridge 440, while the protrusion 450 in FIG. 11G is cusp shaped and exhibits relatively large changes in local slope and curvature. FIG. 11H shows a groove or scoreline structure 460.

In addition to the profile changes illustrated in FIGS. 7 through 11G, the aerodynamic performance of a golf club head 10 according to the present invention can be optimized by adjusting the overall shape of the face edge 25, as shown in FIGS. 12A through 12D. The shapes illustrated in these Figures serve to break-up large scale flow structures by varying the edge geometry. In each of these Figures, a traditional face edge 25 shape is shown in dotted lines. The alternative concepts include a uniform, sinusoidal or scalloped edge shape 510 shown in FIG. 12A, a non-uniform, sinusoidal edge shape 520 shown in FIG. 12B, a uniform, saw tooth edge shape 530 shown in FIG. 12C, and a non-uniform saw tooth edge shape shown in FIG. 12D.

In addition to reducing drag and improving aerodynamic performance, the profile and shape changes disclosed herein serve to increase the visibility of the face, which includes the perimeter modification zone 100, when the golf club head 10 is at the address position. In particular, each of the contours disclosed herein push the striking face 22 out slightly and add a band at the top of the striking face 22 that is oriented in a manner that it is more visible to the golfer at address. The designs of the present invention also serve to make the golf club head 10 more visually distinct and apparent. These effects can be enhanced by giving the perimeter modification zone 100 a different finish than the central portion of the striking face 22. However, even if it were given the same treatment, the change in orientation and curvature of the perimeter modification zone 100 will reflect ambient light differently from the rest of the striking face 22. The presence of a slope or radius discontinuity at the inner edge of the perimeter modification zone 100 also will be visually apparent.

Changes to the contour of the perimeter modification zone 100 will also affect the curvature of the shell structure of the face component 20. These changes to its structural configuration can be exploited to influence striking face 22 compliance and impact dynamic properties to improve ball speed and radiated sound and vibration, which affect the sound and feel of the golf club head 10 during play.

The golf club head 10 of the present invention may be made of one or more materials, may include variable face thickness technology, and may have one or more of the structural features described in U.S. Pat. No. 7,163,468, U.S. Pat. No. 7,163,470, U.S. Pat. No. 7,166,038, U.S. Pat. No. 7,214,143, U.S. Pat. No. 7,252,600, U.S. Pat. No. 7,258,626, U.S. Pat. No. 7,258,631, U.S. Pat. No. 7,273,419, each of which is hereby incorporated by reference in its entirety. In particular, the face component 20 disclosed herein and the surface features of the present invention can be created using forging, forming, and/or machining processes, and the inventive features can be incorporated in their entirety into a face cup construction as well as a face insert or face plate combined with a golf club body.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A wood-type golf club head comprising:

a face component comprising a geometric center, a striking surface, a face edge, and an aerodynamic feature disposed within a perimeter modification zone; and a body comprising a crown, a sole, a heel end, and a toe end, wherein the geometric center and the aerodynamic feature are disposed on the striking surface, wherein the face edge is defined by the intersection between the striking surface and the crown, sole, heel end, and toe end, and extends around the entire periphery of the striking surface, and wherein the perimeter modification zone extends inward from the face edge towards the geometric center by a distance that is no less than 0.050 inch and no more than 0.50 inch.

2. The golf club head of claim 1, wherein the aerodynamic feature is selected from the group consisting of a straight line, a constant radius, and a Nonuniform Rational B-Spline (NURBS) configuration.

3. The golf club head of claim 1, wherein the distance is approximately 0.25 inch.

4. The golf club head of claim 1, wherein the perimeter modification zone comprises at least one secondary surface feature selected from the group consisting of a curvature discontinuity, a step discontinuity, a protrusion, and a groove.

5. The golf club head of claim 4, wherein the secondary surface feature is a protrusion, and wherein the protrusion is selected from the group consisting of a rib and a cusp-shaped ridge.

6. The golf club head of claim 1, further comprising a transition zone extending from the face edge away from the face component onto the body, wherein the transition zone comprises a surface feature selected from the group consisting of a curvature discontinuity, a step discontinuity, a protrusion, and a groove.

7. The golf club head of claim 6, wherein the surface feature is a protrusion, and wherein the protrusion is selected from the group consisting of a rib and a cusp-shaped ridge.

8. The golf club head of claim 1, wherein the face edge has a perimeter shape selected from the group consisting of a uniform, sinusoidal or scalloped shape, a non-uniform, sinusoidal shape, a uniform, saw tooth shape, and a non-uniform saw tooth shape.

9. The golf club head of claim 1, wherein the perimeter modification zone completely encircles the striking surface.

10. The golf club head of claim 1, wherein the perimeter modification zone only partially encircles the striking surface.

11. The golf club head of claim 10, wherein the distance is variable.

12. The golf club head of claim 1, wherein the face component is manufactured from a metal material using a technique selected from the group consisting of forging, forming, and machining.

13. The golf club head of claim 1, wherein the body is composed of a lightweight material selected from a low-density metal alloy and carbon composite.

14. A driver-type golf club head comprising:

a metal face component comprising a geometric center, a striking surface, a face edge, and an aerodynamic feature disposed within a perimeter modification zone; and a body comprising a crown, a sole, a heel end, a toe end, and a transition zone, wherein the geometric center and the aerodynamic feature are disposed on the striking surface, wherein the face edge is defined by the intersection between the striking surface and the crown, sole, heel end, and toe end, and extends around the entire periphery of the striking surface, wherein the transition zone extends from the face edge away from the face component onto the body and comprises a first surface feature selected from the group consisting of a curvature discontinuity, a step discontinuity, a protrusion, and a groove, wherein the perimeter modification zone extends inward from the face edge towards the geometric center by a constant distance of approximately 0.25 inch, wherein the perimeter modification zone completely encircles the striking surface, and wherein the aerodynamic feature is selected from the group consisting of a straight line, a constant radius, and a Nonuniform Rational B-Spline (NURBS) configuration.

15. The driver-type golf club head of claim 14, wherein the perimeter modification zone comprises at least one secondary surface feature selected from the group consisting of a curvature discontinuity, a step discontinuity, a protrusion, and a groove.

16. The driver-type golf club head of claim 15, wherein the face component is forged.

17. A face cup for a golf club head, the face cup comprising:

a striking face comprising a geometric center, a face edge, and an aerodynamic feature disposed within a perimeter modification zone; and a return portion comprising a crown portion, a sole portion, a heel end portion, a toe end portion, and a transition zone, wherein the face edge is defined by the intersection between the striking face and the crown portion, sole portion, heel end portion, and toe end portion, and encircles the striking face, wherein the perimeter modification zone extends inward from the face edge towards the geometric center by a distance of no more than 0.50 inch, wherein the perimeter modification zone completely encircles the striking surface, and wherein the aerodynamic feature is selected from the group consisting of a straight line, a constant radius, and a Nonuniform Rational B-Spline (NURBS) configuration.

18. The face cup of claim 17, wherein at least one of the transition zone and the perimeter modification zone comprises at least one surface feature selected from the group consisting of a curvature discontinuity, a step discontinuity, a protrusion, and a groove.

19. The face cup of claim 17, wherein the distance is variable.

20. The face cup of claim 17, wherein the face edge has a perimeter shape selected from the group consisting of a uniform, sinusoidal or scalloped shape, a non-uniform, sinusoidal shape, a uniform, saw tooth shape, and a non-uniform saw tooth shape.

* * * * *